US012121140B2

(12) United States Patent
Bito

(10) Patent No.: US 12,121,140 B2
(45) Date of Patent: Oct. 22, 2024

(54) LONG-ROD-TYPE CLEANING MACHINE

(71) Applicant: MAKITA CORPORATION, Anjo (JP)

(72) Inventor: Shinya Bito, Anjo (JP)

(73) Assignee: MAKITA CORPORATION, Anjo (JP)

( * ) Notice: Subject to any disclaimer, the term of this patent is extended or adjusted under 35 U.S.C. 154(b) by 328 days.

(21) Appl. No.: 17/641,862

(22) PCT Filed: Jun. 29, 2020

(86) PCT No.: PCT/JP2020/025429
§ 371 (c)(1),
(2) Date: Mar. 10, 2022

(87) PCT Pub. No.: WO2021/079558
PCT Pub. Date: Apr. 29, 2021

(65) Prior Publication Data

US 2022/0322816 A1 Oct. 13, 2022

(30) Foreign Application Priority Data

Oct. 21, 2019 (JP) ..... 2019-192138

(51) Int. Cl.
*A46B 5/00* (2006.01)
*A46B 13/02* (2006.01)

(52) U.S. Cl.
CPC ..... *A46B 5/0083* (2013.01); *A46B 13/02* (2013.01); *A46B 2200/30* (2013.01)

(58) Field of Classification Search
CPC ..... A46B 5/0083
See application file for complete search history.

(56) References Cited

U.S. PATENT DOCUMENTS 5,289,605 A 3/1994 Armbruster
2010/0229315 A1* 9/2010 Rosenzweig ..... B25G 3/38 15/144.1

FOREIGN PATENT DOCUMENTS

CN 101961231 A 2/2011
CN 202437017 U 9/2012
CN 108289580 A 7/2018
(Continued)

OTHER PUBLICATIONS

Jun. 10, 2023 Office Action issued in Chinese Patent Application No. 202080054889.5.
(Continued)

*Primary Examiner* — Andrew A Horton
(74) *Attorney, Agent, or Firm* — Oliff PLC

(57) ABSTRACT

A long rod cleaning machine having an electric motor, a tip tool including a cleaning portion, a head to which the tip tool is attachable, a rod, and a rotator between the head and the rod. The tip tool is attached in a manner movable with a driving force from the electric motor. The head includes a peripheral portion surrounding the cleaning portion and including a surface-cleaning lateral portion to be in contact with a cleaning target surface together with the cleaning portion. The rotator includes a rotation restrictor connecting the head to the rod in a manner rotatable relative to the rod about at least two axes. The rotation restrictor partially or fully restricts rotation of the head.

20 Claims, 12 Drawing Sheets

(56) References Cited

FOREIGN PATENT DOCUMENTS

| | | | |
|---|---|---|---|
| JP | 3024329 | U | 5/1996 |
| JP | 2002-325712 | A | 11/2002 |

OTHER PUBLICATIONS

Aug. 11, 2020 International Search Report issued in International Patent Application No. PCT/JP2020/025429.
Aug. 11, 2020 Written Opinion issued in International Patent Application No. PCT/JP2020/025429.
Jul. 18, 2023 Office Action Issued in Japanese Patent Application No. 2019-192138.

* cited by examiner

LONG-ROD-TYPE CLEANING MACHINE

FIELD

The present disclosure relates to a long rod cleaning machine (elongated rod cleaning machine) such as a long rod scrubber, a long rod polisher, and a long rod buffing machine.

BACKGROUND

A known long rod scrubber is described in U.S. Pat. No. 5,289,605.

BRIEF SUMMARY

A known long rod scrubber may have its rotating disk partially in contact with a target during cleaning, and thus its scrubber unit swinging. The swing is transmitted to the user through a telescopic handle assembly in the scrubber, causing difficulty in cleaning.

One or more aspects of the present disclosure are directed to a long rod cleaning machine that can prevent swinging due to partial contact and can also perform local cleaning.

Solution to Problem

An aspect of the present disclosure provides a long rod cleaning machine, including:

an electric motor;

a tip tool including a cleaning portion;

a head to which the tip tool is attachable, the tip tool being attached in a manner movable with a driving force from the electric motor, the head including a peripheral portion surrounding the cleaning portion and including a surface-cleaning lateral portion configured to be in contact with a cleaning target surface together with the cleaning portion;

a rod; and a rotator between the head and the rod, the rotator including a rotation restrictor connecting the head to the rod in a manner rotatable relative to the rod about at least two axes, the rotation restrictor being configured to partially or fully restrict rotation of the head.

Advantageous Effects

The long rod cleaning machine according to the above aspect of the present disclosure can prevent swinging due to partial contact and can also perform local cleaning.

DETAILED DESCRIPTION

Embodiments and modifications of the present disclosure will now be described with reference to the drawings as appropriate.

A long rod cleaning machine (elongated rod cleaning machine) according to an embodiment is a scrubber.

For ease of explanation, the directional terms such as front, rear, up, down, right, and left in the embodiments and the modifications are defined as viewed from the user in a normal posture (during cleaning a floor), and may be changed depending on, for example, at least the operating situations or the status of a movable member.

The present disclosure is not limited to the embodiments and the modifications.

Figure 1:
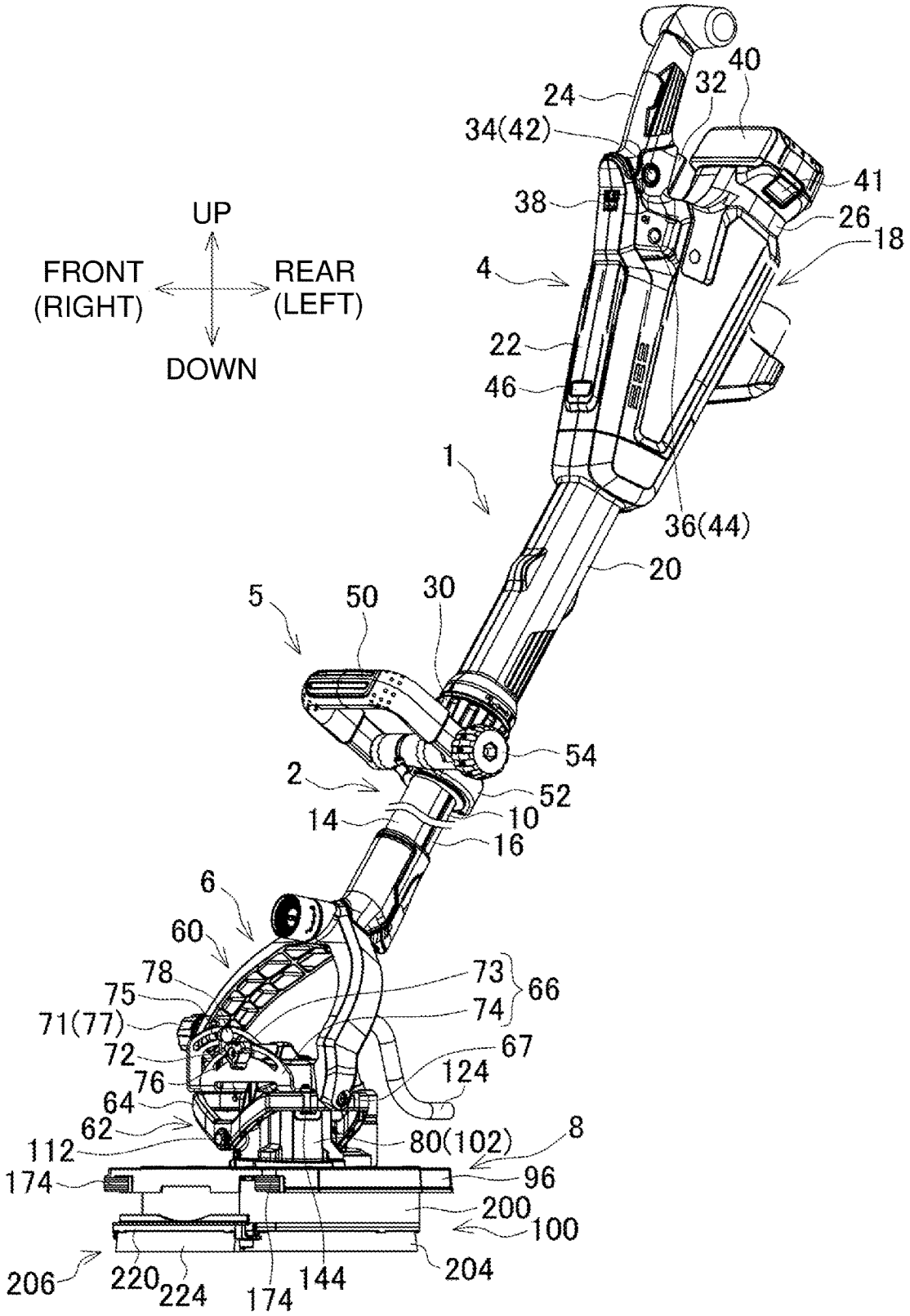
FIG. 1 is a perspective view of a scrubber according to an embodiment.
Figure 2:
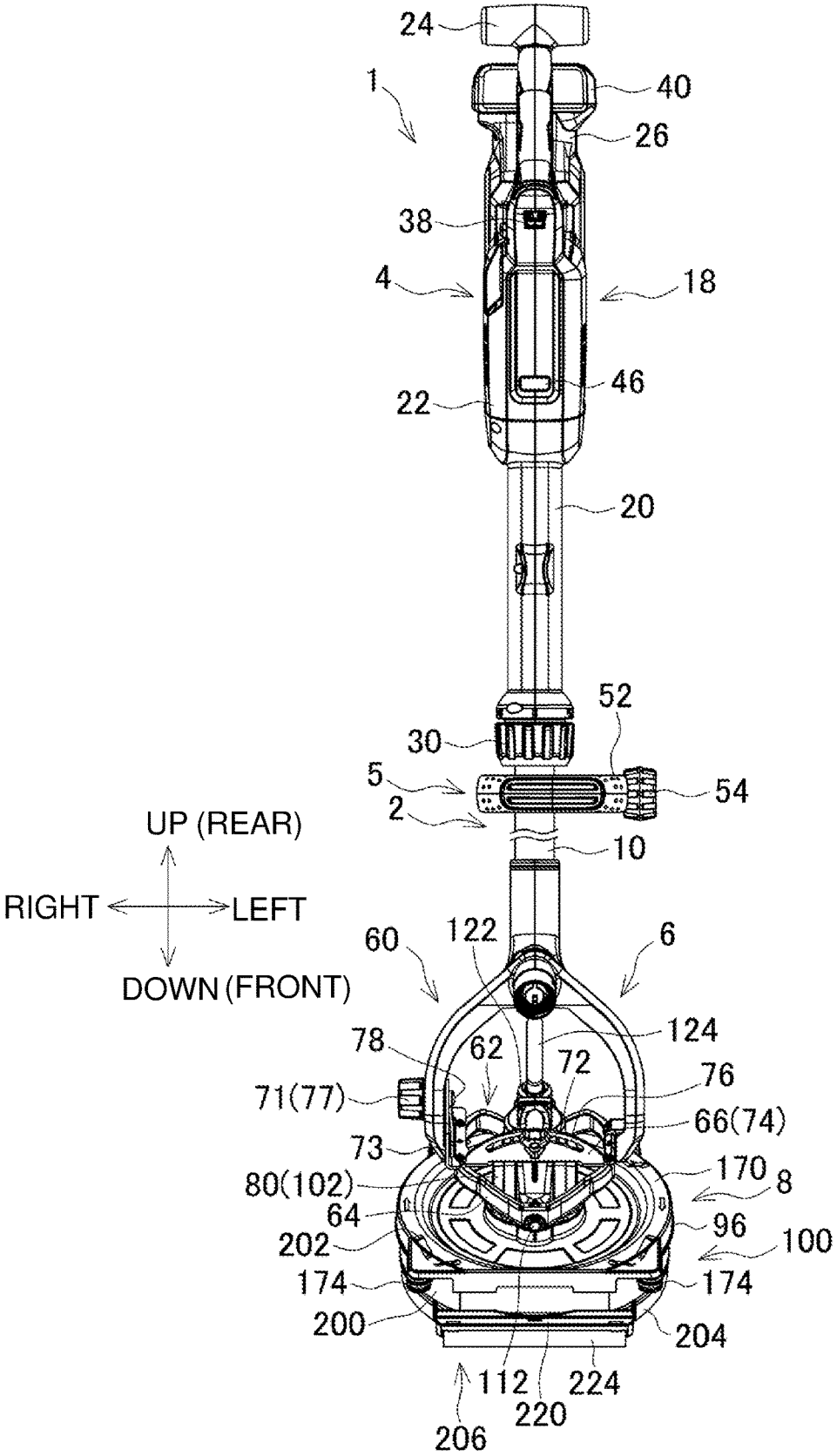
FIG. 2 is a perspective view of the scrubber in FIG. 1 as viewed from the upper front.
Figure 3:
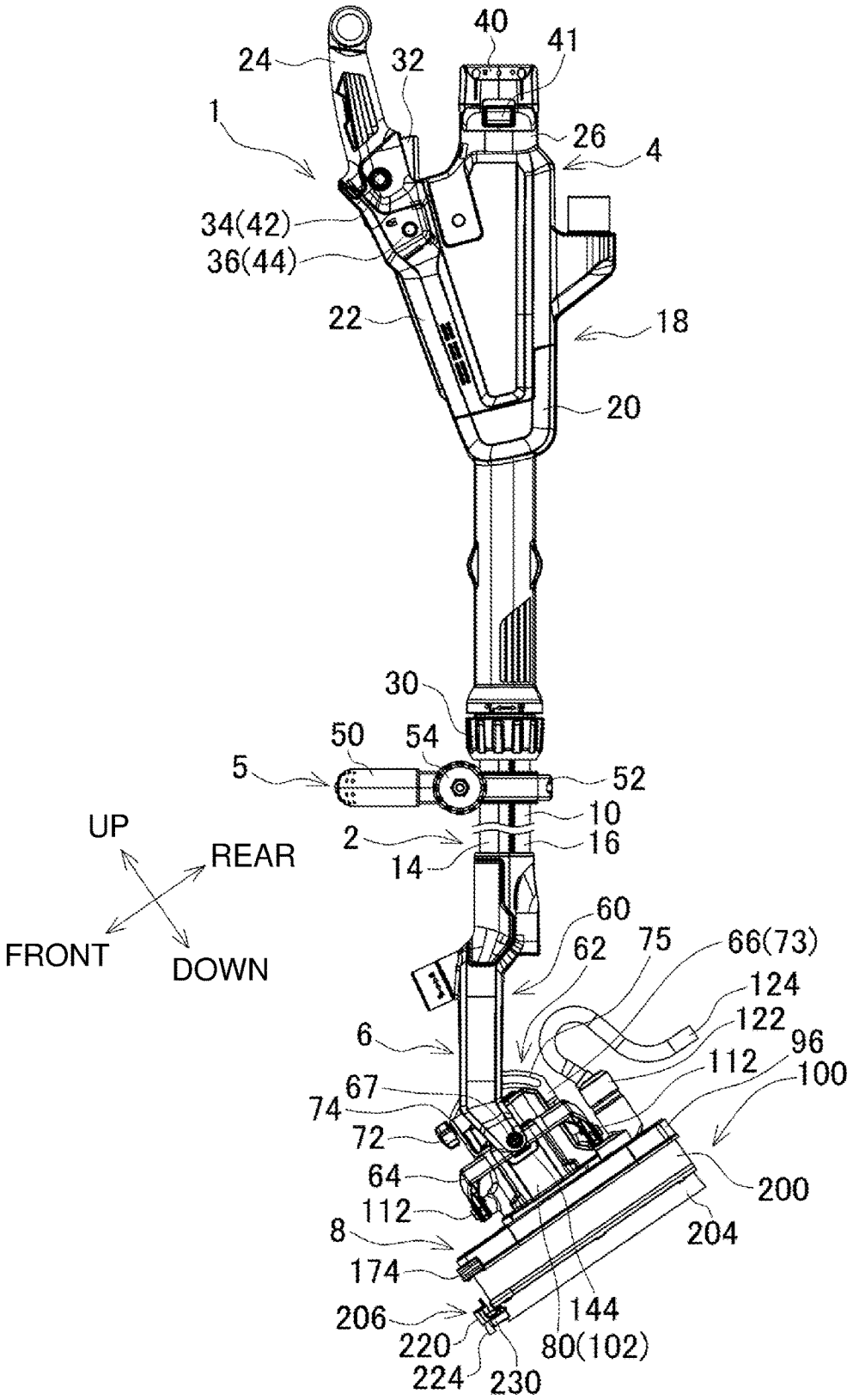
FIG. 3 is a left side view of the scrubber in FIG. 1.

FIG. 1 is a perspective view of a long rod scrubber 1 according to an embodiment. FIG. 2 is a perspective view of the scrubber 1 as viewed from the upper front. FIG. 3 is a left side view of the scrubber 1.

The scrubber 1 includes a rod 2, a body 4, a front grip 5, a suspension frame unit 6 (rotator), and a head 8.

The rod 2 is cylindrical. The rod 2 extends from the lower front to the upper rear of the scrubber 1. The rod 2 may be, for example, a solid rod.

The rod 2 includes a larger-diameter pipe 10 (first rod) and a smaller-diameter pipe (second rod, not shown). The larger-diameter pipe 10 is cylindrical. The smaller-diameter pipe is received in the larger-diameter pipe 10 in a slidable manner. With either the larger-diameter pipe 10 or the smaller-diameter pipe being slidable relative to the other, the rod 2 is telescopic and is extendable and retractable.

The smaller-diameter pipe is cylindrical. The smaller-diameter pipe is attached to the body 4.

The larger-diameter pipe 10 is a double-hollow pipe including a first hollow 14 and a second hollow 16. The smaller-diameter pipe extends through the first hollow 14. The second hollow 16 extends along the lower portion of the first hollow 14. The larger-diameter pipe 10 is formed by extrusion molding of an aluminum material.

The body 4 is located at the upper rear end (second end) of the rod 2.

The outer wall of the body 4 serves as a body housing 18. The body housing 18 has left and right halves joined together and fastened with screws.

The body housing 18 includes a rod housing 20, a grip base 22, a grip 24, and a battery mount 26.

The rod housing 20 houses the rod 2. The rod housing 20 houses the entire smaller-diameter pipe.

The grip base 22 is located at the upper front of an upper rear portion of rod housing 20. The grip base 22 is raised from the upper front surface of the upper rear portion of the rod housing 20 toward the upper front.

The grip 24 is T-shaped as viewed from the front. The grip 24 protrudes from a rear upper portion of the grip base 22 toward the upper rear.

The battery mount 26 is located rearward from the rod housing 20.

An outer cylinder 30 is connected to the front end of the rod housing 20 with a threaded groove and a thread.

With the outer cylinder 30 loosened by the user, the larger-diameter pipe 10 is movable in the front-rear direction relative to the smaller-diameter pipe. The length of the rod 2 is thus changeable. The user tightens the outer cylinder 30 with the rod 2 with an intended length. This fastens the larger-diameter pipe 10. In this manner, the outer cylinder 30 can fasten the rod 2 at any extended or retracted position. FIGS. 1 to 3 do not show a middle portion of the extended rod 2 (larger-diameter pipe 10).

When the rod 2 is retracted, the larger-diameter pipe 10 passes between the body housing 18 (rod housing 20) and the smaller-diameter pipe.

With the rod 2 retracted to its shortest length, the suspension frame unit 6 is located in front of the outer cylinder 30 (front grip 5).

The body 4 includes the body housing 18, a terminal (not shown), a switch (not shown), a trigger 32, a locking member 34, a trigger locking member 36, a speed adjustment dial 38, and a controller (not shown).

The terminal is held on the battery mount 26 in the body housing 18. The terminal can receive a battery 40 as a power supply in a slidable manner. The battery 40 is rechargeable with a charger (not shown). The battery 40 has a rectangular parallelepiped (rectangular prism) shape. The battery 40 is, for example, a lithium-ion battery with an output of 18 V. The battery 40 is a versatile battery that can be used in any other power tool. When attached to the battery mount 26, the battery 40 is electrically connected to the terminal. The battery 40 includes a battery button 41. The battery 40 attached to the battery mount 26 can be detached by operating the battery button 41.

The switch is held in a base in a lower portion of the grip 24.

The trigger 32 extends along the base of the grip 24. The trigger 32 is located rearward and downward from the switch. The trigger 32 has its rear exposed from the grip 24. The trigger 32 is swingable about an axis extending laterally. The trigger 32 is pulled upward to turn on the switch.

The locking member 34 extends laterally. The locking member 34 is located in front of the trigger 32. The locking member 34 has its left and right ends exposed to serve as locking buttons 42. The user presses (turns on) either the left or right locking button 42 while holding the trigger 32 pulled to move the locking member 34, which then engages with a middle portion of the trigger 32. This prevents the trigger 32 released from the pull from returning downward, thus maintaining the trigger 32 in the pulled state. With the locking button 42 turned on, the switch remains on. In response to the user pulling the trigger 32 further upward, the locking member 34 returns to its original position, thus releasing the pull of the trigger 32. The switch is no longer on.

The trigger locking member 36 extends laterally. The trigger locking member 36 is located below the trigger 32. The trigger locking member 36 has its left and right ends exposed to serve as trigger locking buttons 44. The user presses (turns on) the left trigger locking button 44 without pulling the trigger 32 to cause the trigger locking member 36 to engage with the front end of the trigger 32. This prevents upward movement of the rear (downward movement of the front) of the trigger 32 to restrict the trigger 32 from being pulled. In response to the user pressing (turning off) the right trigger locking button 44, the trigger locking button 44 that has returned leftward removes the restriction on pulling the trigger 32.

The speed adjustment dial 38 held in an upper front portion of the grip base 22 is partially exposed. The user operates the speed adjustment dial 38 to change the switching state of the speed adjustment dial 38. The switching state of the speed adjustment dial 38 corresponds to a speed setting.

The controller (not shown) is held in the body housing 18.

The controller is electrically connected to the terminal on the battery mount 26, the switch for the trigger 32, and the speed adjustment dial 38 with lead wires (not shown).

The controller includes a display 46. The display 46 includes four light-emitting diodes (LEDs) (not shown) in its upper portion, which is exposed from the upper surface of the body housing 18. The controller displays, on the display 46, the remaining battery level of the battery 40 connected to the terminal and whether the motor load is high or low.

A rod lead wire (not shown) extending to the head 8 is connected to the controller. The rod lead wire is a bundle of single lead wires. One of the single lead wires (control lead wire) is connected to the controller. Another one of the single lead wires (power lead wire) is connected to the terminal. In other words, the rod lead wire is connected to the body 4. The rod lead wire as a single bundle first extends rearward in the body housing 18, turns (bends) in a U shape to extend frontward, and enters the second hollow 16 in the larger-diameter pipe 10.

The front grip 5 is located radially outward from the rod 2. The front grip 5 may be eliminated.

The front grip 5 includes a front grip body 50, a connector 52, and a bolt 54.

The front grip body 50 is U-shaped as viewed from above. The front grip body 50 entirely protrudes frontward. The front grip body 50 has its two ends bent inward in the lateral direction.

The connector 52 is a-shaped as viewed from above. The connector 52 includes an annular portion surrounding the rod 2. The connector 52 includes two portions extending laterally. Each of the two portions faces its corresponding end of the front grip body 50. The end faces of the portions of the connector 52 extending laterally and the end faces of the front grip body 50 are cams that can mesh with each other. Each cam has multiple triangular portions extending radially. The triangular portions are arranged circumferentially.

The bolt 54 is received both in the portions of the connector 52 extending laterally and in the ends of the front grip body 50 extending laterally.

With the bolt 54 loosened, the annular portion of the connector 52 is loosened to allow the front grip 5 to be movable relative to the rod 2. With the bolt 54 loosened, the cams are disengaged from each other to allow the front grip body 50 to be at different angles relative to the connector 52.

The user tightens the bolt 54 with the front grip body 50 at an intended angle and the connector 52 at an intended position on the rod 2. The annular portion of the connector 52 is then tightened with respect to the rod 2 to fix the position of the front grip 5 on the rod 2. The cams in contact with each other are also fixed to fix the angle of the front grip body 50 relative to the connector 52.

Figure 4:
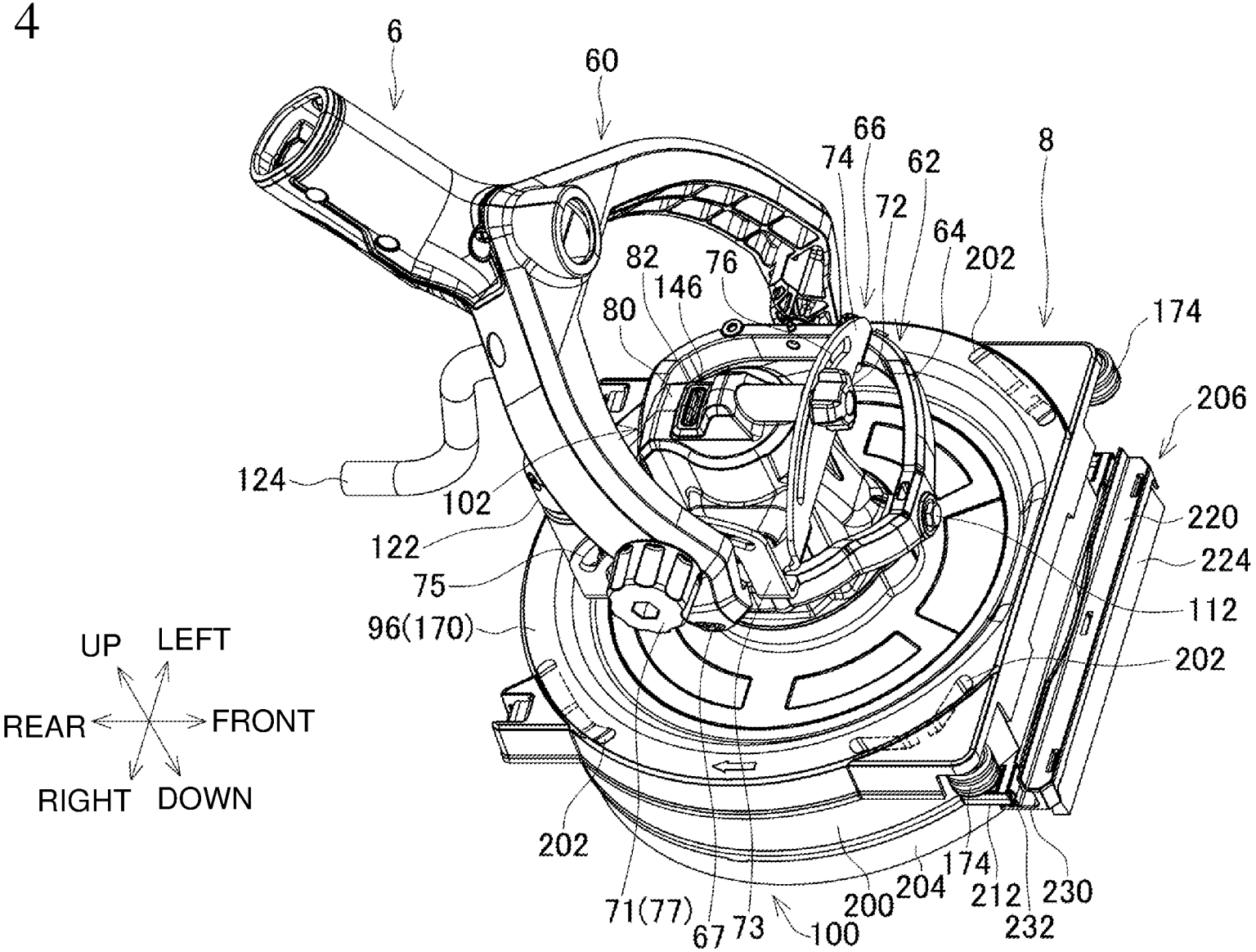
FIG. 4 is a perspective view of a suspension frame unit and a head in the scrubber in FIG. 1.
Figure 5:
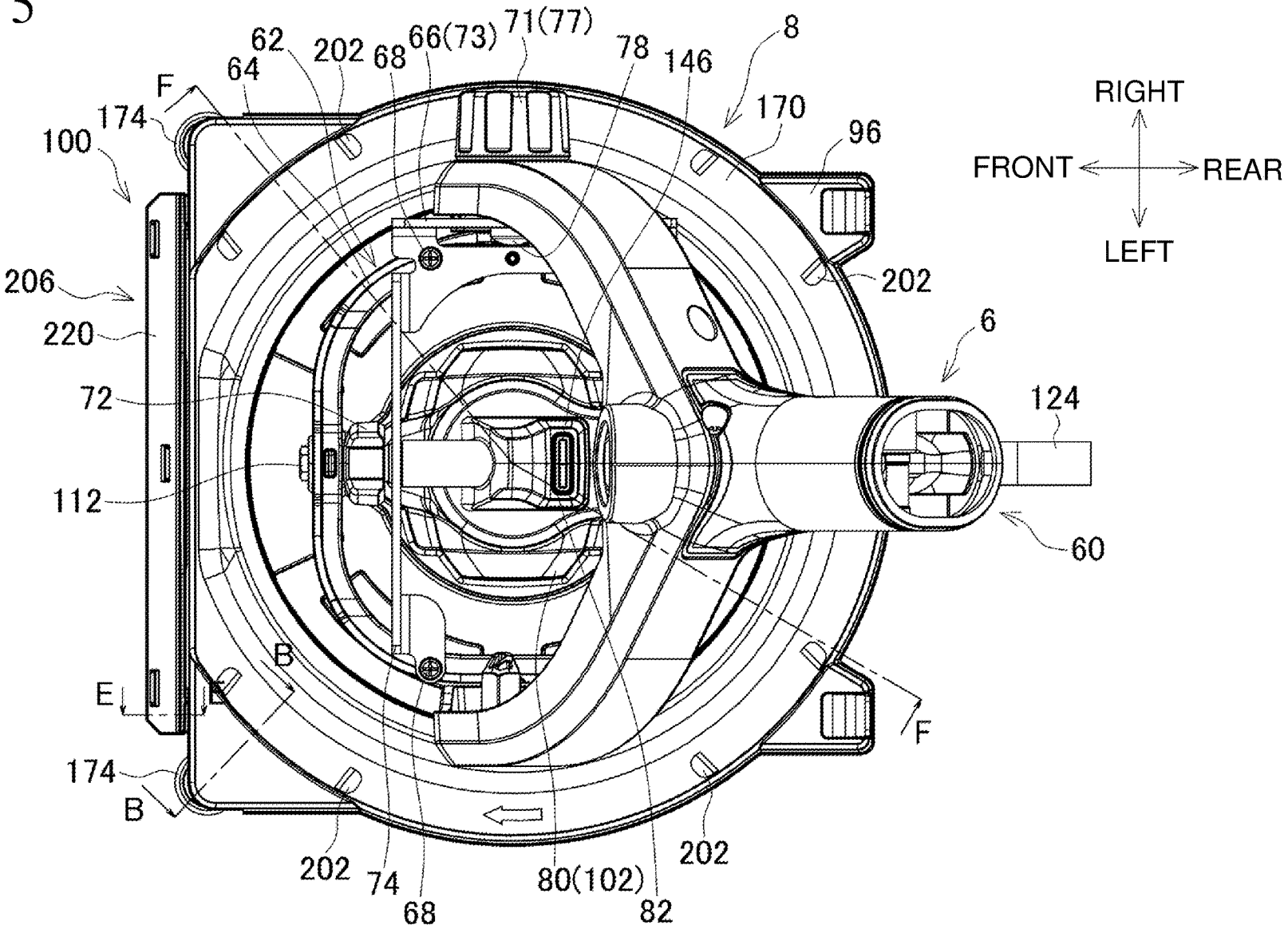
FIG. 5 is a top view of the suspension frame unit and the head in FIG. 4.
Figure 6:
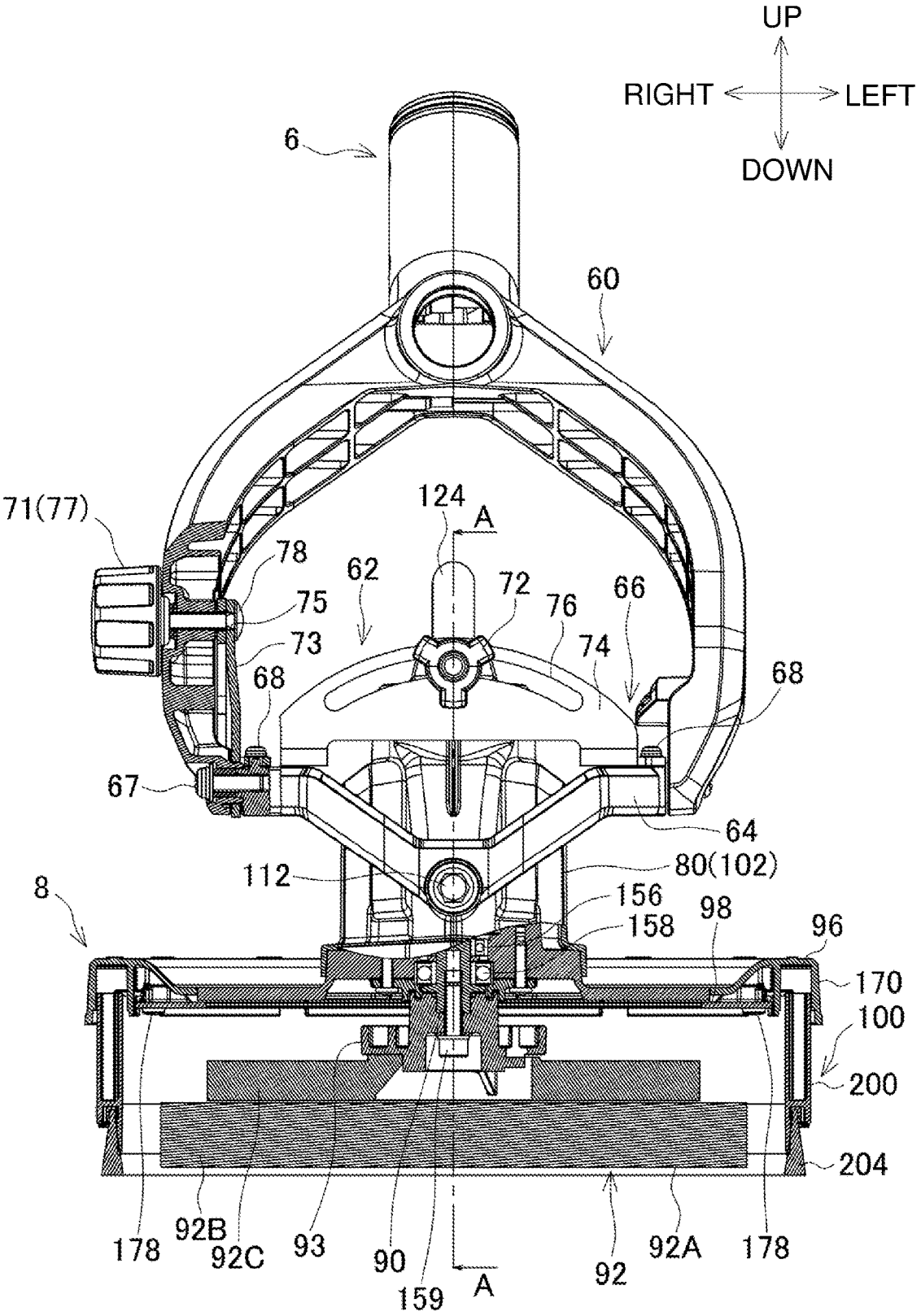
FIG. 6 is a front view of the suspension frame unit and the head in FIG. 4.
Figure 7:
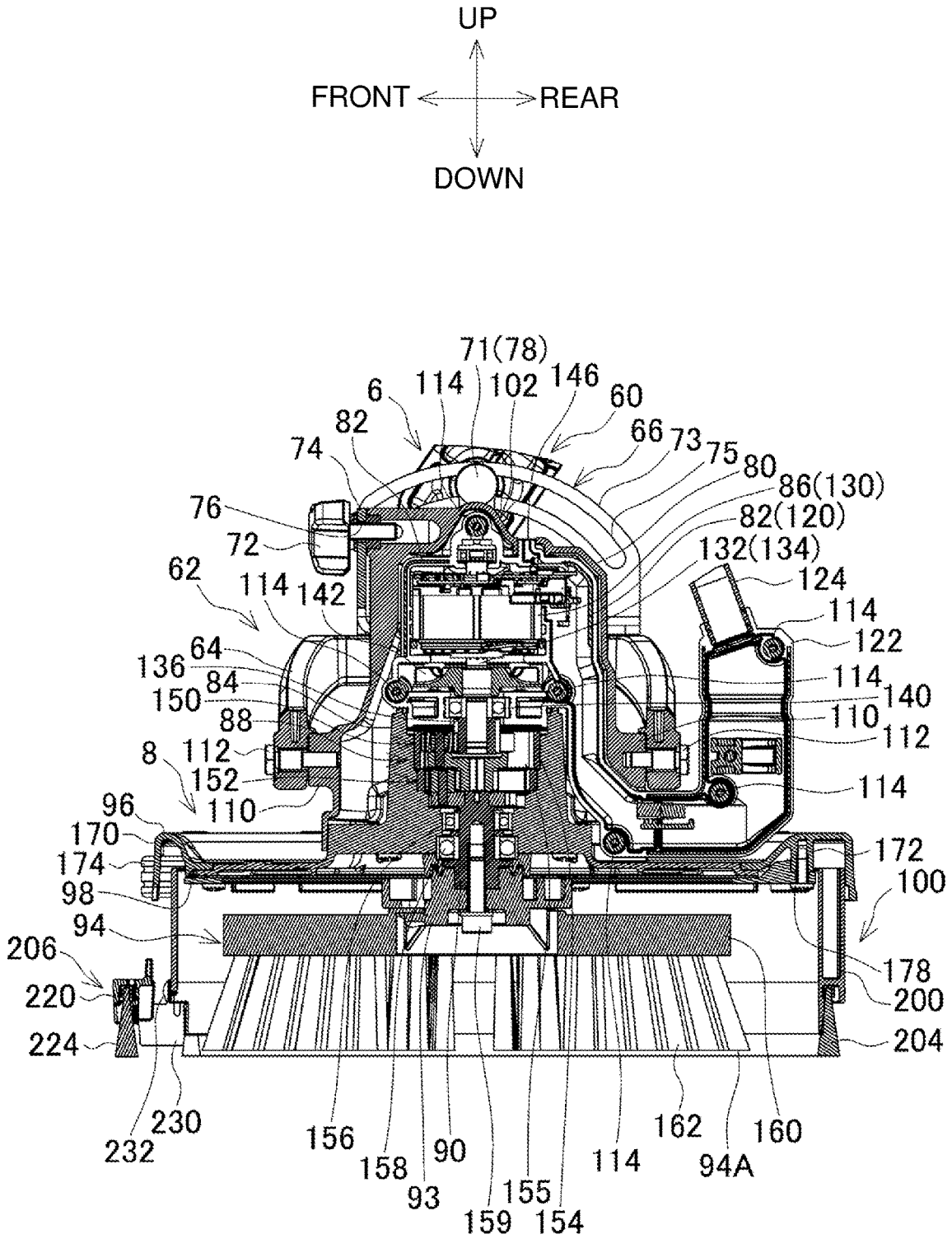
FIG. 7 is a cross-sectional view taken along line A-A in FIG. 6.
Figure 8:
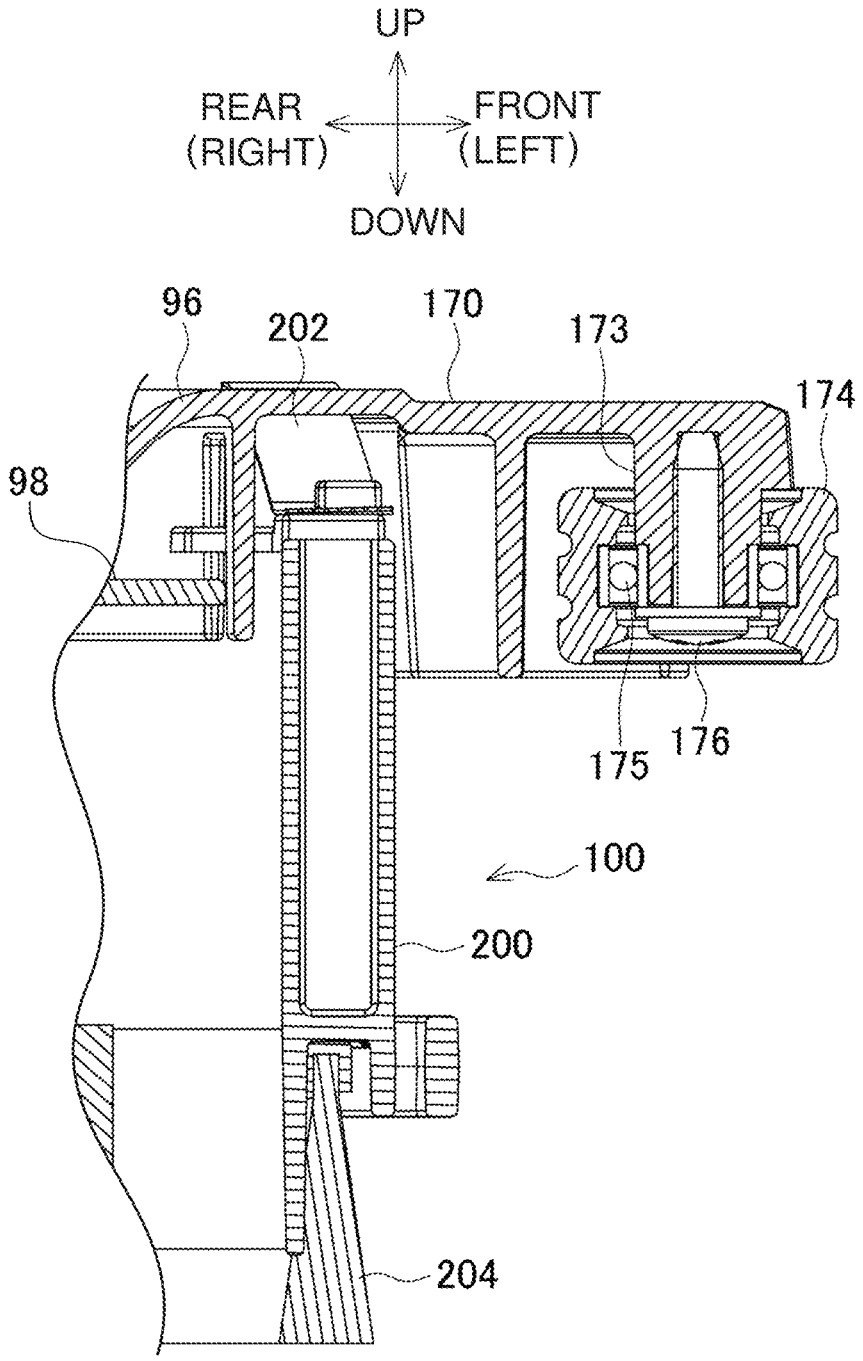
FIG. 8 is a cross-sectional view taken along line B-B in FIG. 5.
Figure 9:
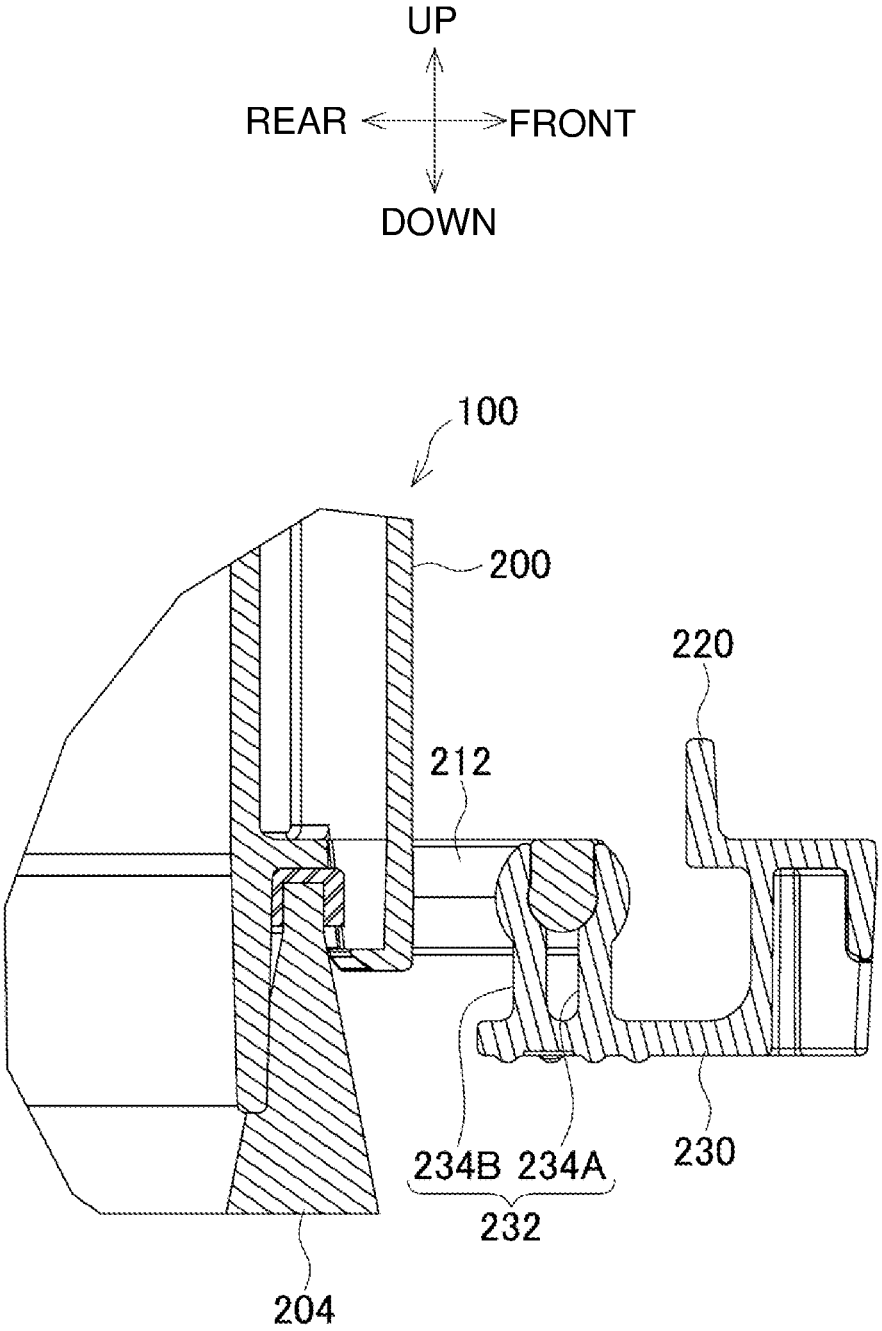
FIG. 9 is a cross-sectional view taken along line E-E in FIG. 5.
Figure 10:
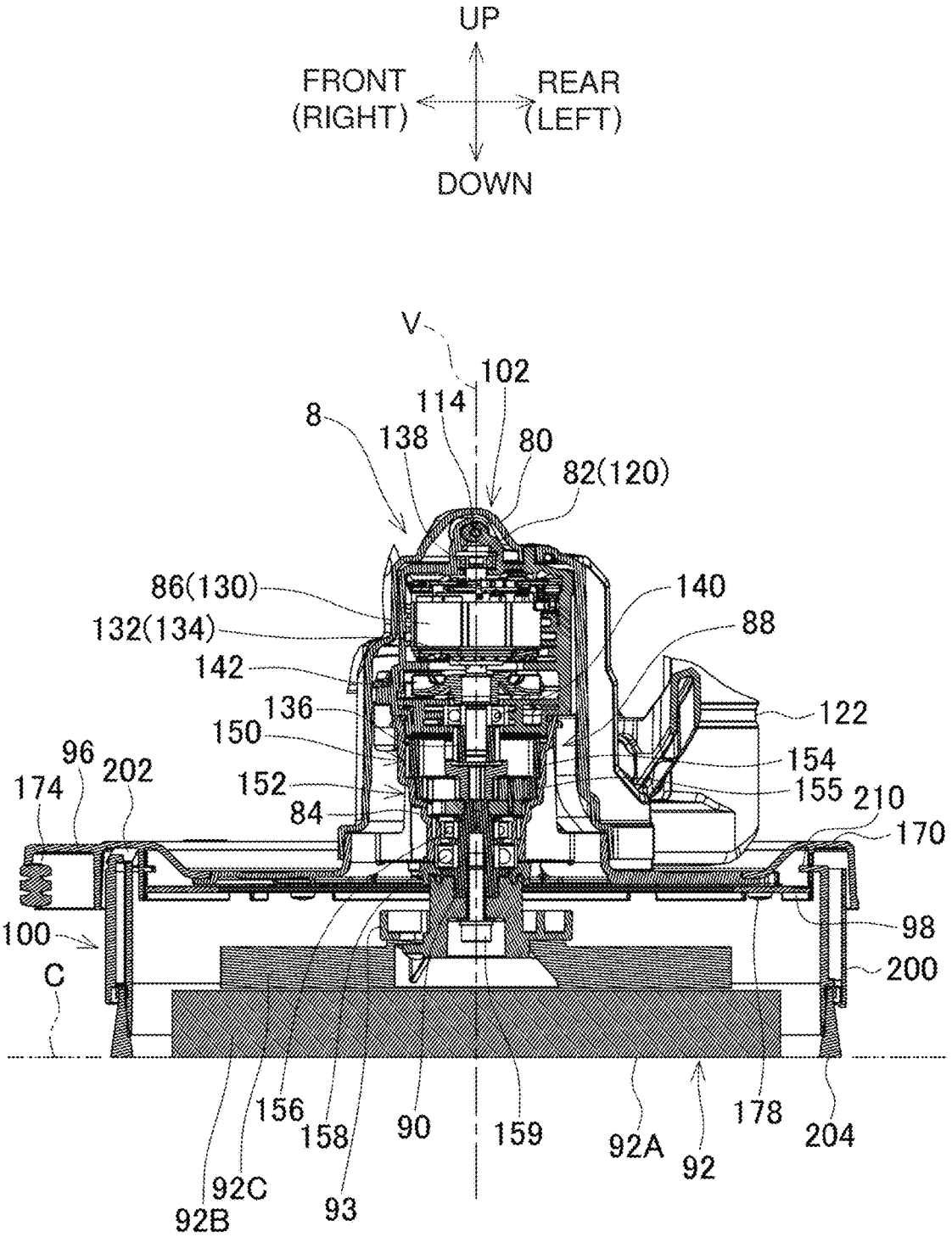
FIG. 10 is a cross-sectional view taken along line F-F in FIG. 5, showing the head pressed against a cleaning target surface.

FIG. 4 is a perspective view of the suspension frame unit 6 and the head 8. FIG. 5 is a top view of the suspension frame unit 6 and the head 8. FIG. 6 is a front view of the suspension frame unit 6 and the head 8, showing a lower portion of the head 8 in a central cross-sectional view and a right portion of the suspension frame unit 6 in a cross-sectional view. FIG. 7 is a cross-sectional view taken along line A-A in FIG. 6, showing the head with a brush attached in a central sectional view. FIG. 8 is a cross-sectional view taken along line B-B in FIG. 5. FIG. 9 is a cross-sectional view taken along line E-E in FIG. 5. FIG. 10 is a cross-sectional view taken along line F-F in FIG. 5, the machine having a vertical axis V, FIG. 10 also showing the head 8 pressed against a cleaning target surface C.

The suspension frame unit 6 is connected to the lower front end (first end) of the rod 2.

The suspension frame unit 6 includes an outer frame 60 (first frame) and an inner frame 62 (second frame).

The outer frame 60 is laterally bifurcated. The outer frame 60 is formed from resin. The outer frame 60 is attached to a distal end of the larger-diameter pipe 10.

The inner frame 62 includes an inner frame body 64, a guide 66, a first restriction bolt 71, and a second restriction bolt 72. The inner frame body 64 and the guide 66 are formed from metal. The first restriction bolt 71 and the second restriction bolt 72 are rotation restrictors. The rotation restrictors may include the guide 66.

The inner frame body 64 is rectangular as viewed from above. The inner frame body 64 is connected inside the distal ends of the outer frame 60 with first axial bolts 67 to be rotatable about the axis in the lateral direction. The first axial bolts 67 are arranged in the lateral direction and extend laterally. The inner frame body 64 is V-shaped as viewed from the front and from the rear.

The head 8 is located between the lowermost ends of the V-shaped portions of the inner frame body 64. The head 8 is connected to the inner frame body 64 with second axial bolts 112 in a manner rotatable about the axis in the front-rear direction. The second axial bolts 112 are arranged in the front-rear direction and extend in the front-rear direction.

The suspension frame unit 6 allows the head 8 to change its posture about the two axes, or the lateral rotation axis (first rotation axis) and the front-rear rotation axis (second rotation axis). The relatively large outer frame 60 allows the head 8 to change its posture about the first rotation axis. The relatively small inner frame 62 allows the head 8 to change its posture about the second rotation axis. The first rotation axis includes the center axes of the first axial bolts 67. The second rotation axis includes the center axes of the second axial bolts 112.

The guide 66 is L-shaped as viewed from above. The guide 66 is attached to the inner frame body 64 with multiple screws 68 extending vertically. The guide 66 is located on front and upper right portions of the inner frame body 64. The guide 66 may be, for example, welded or integrally formed. The guide 66 may be located on rear and left portions of the inner frame body 64.

The guide 66 includes a first standing portion 73 and a second standing portion 74. The first standing portion 73 stands upward on an upper front portion of the inner frame body 64. The second standing portion 74 stands upward on an upper right portion of the inner frame body 64. In the drawings, the first standing portion 73 extends in the front-rear and vertical directions. The first standing portion 73 is adjacent to the inner surface of the end of the right bifurcation of the outer frame 60 in the lateral direction. The first standing portion 73 has a first guide hole 75 extending in an arc. In the drawings, the second standing portion 74 extends in the vertical and lateral directions. The second standing portion 74 is adjacent to the upper front surface of the head 8. The second standing portion 74 has a second guide hole 76 extending in an arc.

The first restriction bolt 71 includes a knob 77 and a bolt 78. The knob 77 is a solid cylinder. The bolt 78 is received in the knob 77. The bolt 78 extends through a hole that extends laterally in the end of the right bifurcation of the outer frame 60 and in the first guide hole 75. The bolt 78 has its head on the left of the first standing portion 73.

In response to the knob 77 being rotated in a predetermined direction (tightening direction), the head of the bolt 78 is pressed against the first standing portion 73 to fix the first standing portion 73 to the outer frame 60 in a nonrotatable manner. More specifically, the first restriction bolt 71 is tightened to fix the outer frame 60 and the first standing portion 73 of the guide 66, which are movable relative to each other, to restrict the first standing portion 73 from rotating relative to the outer frame 60 (the head 8 from rotating about the first rotation axis).

In response to the knob 77 being rotated in the reverse direction (loosening direction), the head of the bolt 78 pressed against the first standing portion 73 is released. This allows the first standing portion 73 to rotate relative to the outer frame 60. As the first standing portion 73 rotates, the bolt 78 moves accordingly along the first guide hole 75.

The first restriction bolt 71 is operable by rotating the knob 77 manually without using a tool (in a toolless manner).

The second restriction bolt 72 is received in an upper front portion of the head 8. The second restriction bolt 72 passes through the second guide hole 76. The second restriction bolt 72 receives a small knob on its head. The small knob may be as large as or larger than the knob 77. The small knob may be eliminated.

In response to the second restriction bolt 72 being rotated in a predetermined direction (tightening direction), the head of the second restriction bolt 72 is pressed against the second standing portion 74 to fix the head 8 to the second standing portion 74 in a nonrotatable manner. More specifically, the second restriction bolt 72 is tightened to fix the inner frame 62 and the head 8, which are movable relative to each other, to restrict the head 8 from rotating relative to the second standing portion 74 (the head 8 from rotating about the second rotation axis).

In response to the second restriction bolt 72 being rotated in the reverse direction (loosening direction), the head of the second restriction bolt 72 pressed against the second standing portion 74 is released. This allows the head 8 to rotate relative to the second standing portion 74. As the head 8 rotates, the second restriction bolt 72 moves accordingly along the second guide hole 76.

The second restriction bolt 72 is operable by rotating the small knob manually without using a tool (in a toolless manner).

The head 8 includes a head outer housing 80, a motor housing 82, a gear housing 84, an electric motor 86 as a driving source, a planetary gear assembly 88, a spindle 90, a pad 92 or a brush 94 (first brush) as a tip tool, a tip tool adapter 93, a head cover 96, a stopper 98, and a peripheral portion 100.

A head housing 102 includes the head outer housing 80, the motor housing 82, and the gear housing 84.

The head outer housing 80 is bell-shaped. The head outer housing 80 includes bosses 110 in the front and rear of the head outer housing 80. The suspension frame unit 6 (inner frame 62) is connected to the bosses 110 with second axial bolts 112 in a manner rotatable relative to each other.

The motor housing 82 is located radially inside the head outer housing 80. The motor housing 82 includes left and right halves combined with multiple (six) screws 114.

The motor housing 82 includes a cylindrical motor housing body 120, a cylindrical portion 122, and a hose 124. The cylindrical portion 122 extends rearward and downward from the rear of the motor housing body 120 to protrude in a J shape as viewed laterally.

The cylindrical portion 122 extends outside from an opening in the rear of the head outer housing 80.

The hose 124 is connected to the rear upper end of the cylindrical portion 122. The hose 124 is routed to remain hook-shaped as viewed laterally. The rod lead wire extending from the front end of the second hollow 16 in the larger-diameter pipe 10 extends inside the hose 124 and the cylindrical portion 122.

The gear housing 84 is attached to a lower portion of the motor housing 82. The gear housing 84 has a cylindrical upper portion. The gear housing 84 has a disk-shaped lower portion.

The gear housing 84 has an opening in its upper end, which receives the lower end of the motor housing body 120. The rim of the upper surface of the lower portion of the gear housing 84 is received in the opening in the lower end of the head outer housing 80. The gear housing 84, together with the motor housing 82, is attached to the head outer housing 80.

The electric motor 86 is a direct current (DC)-driven brushless motor. The electric motor 86 is held inside an upper portion of the motor housing body 120.

The electric motor 86 includes a stator 130 and a rotor 132.

The rod lead wire is connected to the electric motor 86. The controller (not shown) controls the electric motor 86.

The stator 130 is cylindrical. The rotor 132 is a multistage solid cylinder having multiple diameters. The rotor 132 is located inside the stator 130 (inner rotor). The rotor 132 includes a motor shaft 134 as a rotary drive shaft. A pinion 136 is attached to the lower end of the motor shaft 134. The motor shaft 134 is supported by an upper bearing 138 and a lower bearing 140 in a manner rotatable about the central axis of the motor shaft 134. The upper bearing 138 and the lower bearing 140 are held on the motor housing 82.

A cooling fan 142 is located above the lower bearing 140 for the motor shaft 134. The fan 142 is fastened to the motor shaft 134. The fan 142 is a centrifugal fan. The fan 142 rotates to create a blow in the centrifugal direction. The fan 142 is located inside a middle portion of the motor housing 82. The motor housing 82 has internal outlets (not shown) in its left and right middle portions. The head outer housing 80 has external outlets 144 (FIGS. 1 and 3) in its left and right middle portions and outward from the internal outlets. The internal outlets and the external outlets 144 are radially outside the fan 142. The blow from the fan 142 is thus discharged efficiently.

The motor housing body 120 has an inlet 146 in its upper portion. The inlet 146 is exposed through an opening in an upper portion of the head outer housing 80.

The gear housing 84 serves as an outer wall for the planetary gear assembly 88. The planetary gear assembly 88 is held on an upper portion of the gear housing 84. The planetary gear assembly 88 includes double-stage planetary gear trains each having a vertical axis at its center. The axis includes the center axes of the motor shaft 134 and the spindle 90. The planetary gear assembly 88 reduces the rotation of the motor shaft 134 and transmits the rotation to the spindle 90. The planetary gear assembly 88 includes an upper planetary gear train 150 (reducer in a first stage), a lower planetary gear train 152 (reducer in a second stage), an internal gear 154 in the upper planetary gear train 150, and an internal gear 155 in the lower planetary gear train 152.

The pinion 136 meshes with the upper planetary gear train 150. The spindle 90 has the rear end attached to a carrier in the lower planetary gear train 152.

The spindle 90 is located in a lower portion of the gear housing 84. The spindle 90 is supported by a spindle upper bearing 156 and a spindle lower bearing 158 in a manner rotatable about the center axis of the spindle 90. The spindle upper bearing 156 and the spindle lower bearing 158 are held on the gear housing 84.

As shown in FIG. 6, the pad 92 is attached below the spindle 90 with the tip tool adapter 93 in between.

The pad 92 is located below the motor housing 82.

The pad 92 includes a pad body 92B and a pad base 92C.

The pad body 92B is formed from, for example, a nonwoven fabric, and can wipe a cleaning target surface C such as a floor with a pad lower surface 92A being a lower surface of the pad body 92B.

The pad base 92C is a disk having a center hole. The pad body 92B is fixed to the lower surface of the pad base 92C. The pad base 92C receives a lower portion of the tip tool adapter 93 in its center hole for attachment to the tip tool adapter 93. The center hole in the pad base 92C and the lower portion of the tip tool adapter 93 are shaped to correspond to each other.

The pad 92 can be attached to and detached from the tip tool adapter 93 without using a tool (in a toolless manner). For example, the tip tool adapter 93 may include one or more tabs fixing the pad 92 in response to the rotation of the pad 92 in the forward rotation direction. The tabs are engaged with the center hole in the pad base 92C for attachment of the pad 92. The pad 92 rotates reversely and is disengaged from the tabs on the tip tool adapter 93. The pad 92 is thus detached.

The tip tool adapter 93 is attached to the lower end of the spindle 90 with a screw 159. The tip tool adapter 93 and the spindle 90 may be integral with each other. More specifically, the spindle 90 may have its lower end shaped similarly to the tip tool adapter 93. In this case, the screw 159 is eliminated.

As shown in FIG. 7, the brush 94, instead of the pad 92, may be attached to the spindle 90 by detachment from and attachment to the tip tool adapter 93.

The brush 94 includes a brush base 160 and a bristle portion 162. The brush base 160 is disk-shaped. The brush base 160 has a center hole similar to the center hole in the pad base 92C. The brush base 160 is attached to and detached from the tip tool adapter 93, using its center hole, without using a tool (in a toolless manner). The bristle portion 162 includes multiple bristle bundles extending from the brush base 160. The brush 94 can scrub a cleaning target surface C with a brush lower end 94A being the lower end of the bristle portion 162.

The head cover 96 is annular. The head cover 96 has its radially outer portion as a receiver 170 raised upward from its inner portion. The internal space (lower surface) of the receiver 170 is recessed upward. Multiple (five) screw bosses 172 are located adjacent to the receiver 170. The screw bosses 172 are arranged in the circumferential direction of the head cover 96. As shown in FIG. 8, a screw boss shaft 173 is located at each of the right front corner and the left front corner of the head cover 96. The screw boss shaft 173 protrudes downward from its surrounding portion. Each screw boss shaft 173 receives a roller 174 that can rotate bidirectionally in response to an external force. A bearing 175 is placed between each screw boss shaft 173 and the corresponding roller 174. Each bearing 175 is fastened with a screw 176 received in the screw boss shaft 173.

The stopper 98 is located below the head cover 96. The stopper 98 is annular. The stopper 98 receives, from below, multiple screws 178 corresponding to the screw bosses 172 in the vertical direction. This fastens the stopper 98 to the head cover 96.

The head cover 96 and the stopper 98 are attached to a radially outer portion of the lower end (disk-shaped portion) of the gear housing 84. The disk-shaped portion of the gear housing 84 has its edge held between the radially inner edge of the head cover 96 and the radially inner edge of the stopper 98. Under an external force, the head cover 96 and the stopper 98 can rotate around the disk-shaped portion of the gear housing 84 bidirectionally by 360 degrees.

The peripheral portion 100 is located below the head cover 96. The peripheral portion 100 is cylindrical.

The peripheral portion 100 includes a peripheral body 200, multiple (four) leaf springs 202, a peripheral body brush 204, and a peripheral attachment 206. The leaf springs 202 are peripheral elastic members. The peripheral body brush 204 is a part of a surface-cleaning lateral portion.

The peripheral body 200 is a cylinder partially including a flat surface. In FIG. 4, the front end of the peripheral body 200 is the flat surface extending vertically and laterally. The peripheral body 200 is located below the receiver 170 in the head cover 96. Multiple (six) projections 210 are located on the upper end of the peripheral body 200 (FIG. 10). Each projection 210 protrudes radially inward from the upper end of the inner surface of the cylindrical portion. Each projection 210 is in contact with the upper surface of the stopper 98 in states other than the state shown in FIG. 10. The stopper 98 thus prevents the peripheral portion 100 from slipping off downward. The head cover 96 has its lower surface above the projections 210 with a clearance between them. An attachment holder 212 having an L shape as viewed from above is integral with each of the sides (in the drawings, the left and the right) of the flat surface of the peripheral body 200. In the drawings, each attachment holder 212 has one side extending laterally shaped like a shaft.

Each leaf spring 202 is V-shaped. The leaf springs 202 are placed between the peripheral body 200 and the head cover 96. Each leaf spring 202 has its center fixed to the upper end of the peripheral body 200. Each leaf spring 202 has its center fixed to the upper end of the peripheral body 200. Each leaf spring 202 has its two ends fixed to the head cover 96. The leaf springs 202 are located in right front, left front, right rear, and left rear portions. Some or all of the leaf springs 202 may be fixed to either the head cover 96 or the peripheral body 200.

The peripheral body brush 204 includes multiple bristle bundles. The bristle bundles extend downward from the lower end of the peripheral body 200 excluding the flat surface. The bristle bundles have their lower ends aligned in a single imaginary plane.

The peripheral attachment 206 includes a peripheral attachment body 220 and a peripheral attachment brush 224. The peripheral attachment brush 224 is a part of the surface-cleaning lateral portion. The peripheral body brush 204 and the peripheral attachment brush 224 as second brushes form the surface-cleaning lateral portion.

The peripheral attachment body 220 is a rod. The peripheral attachment body 220 has the same length as the peripheral body 200 in the longitudinal direction. The peripheral attachment body 220 has, on its two ends, protrusions 230 protruding in the same direction (rearward in the drawings).

Each protrusion 230 has an attaching portion 232. Each attaching portion 232 includes a pair of plates 234A and 234B. The pair of plates 234A and 234B protrude upward from the upper surface of the attaching portion 232. The pair of plates 234A and 234B face each other. The upper ends of the pair of plates 234A and 234B are each shaped into a half cylinder. Each attaching portion 232 is detachably attached to the corresponding attachment holder 212 in the peripheral body 200. The shaft-shaped portion of the attachment holder 212 is held between the upper ends of the plates 234A and 234B.

The peripheral attachment brush 224 includes multiple bristle bundles. The bristle bundles extend downward from the lower end of the peripheral attachment body 220. The bristle bundles have their lower ends aligned in the same single imaginary plane as for the peripheral body brush 204.

FIG. 9 does not show the peripheral attachment brush 224. The peripheral attachment 206 may be eliminated. In this case, the peripheral body brush 204 may be annular.

The peripheral body 200, the peripheral body brush 204, and the peripheral attachment 206 surround the radially outer edge of the pad 92 or the brush 94. The peripheral portion 100 (the peripheral body brush 204 and the peripheral attachment brush 224) surrounds the lower surface (pad lower surface 92A) of the pad body 92B in the pad 92 or the lower end (brush lower end 94A) of the bristle portion 162 of the brush 94, or in other words, a cleaning portion of the tip tool. The cleaning portion of the tip tool performs cleaning. The lower ends of the bristle bundles of the peripheral body brush 204 and the peripheral attachment brush 224 are located downward from the cleaning portion of the tip tool in the vertical direction in states other than the state shown in FIG. 10.

The leaf springs 202 urge, through the peripheral body 200, the peripheral body brush 204 and the peripheral attachment brush 224 downward, or more specifically, toward the cleaning target surface C.

The scrubber 1 according to the present embodiment may operate in the manner described below.

The user slides the charged battery 40 from the right to the left of the battery mount 26 to attach the battery 40 to the battery mount 26.

The user loosens the outer cylinder 30 to extend or retract the rod 2 and tightens the outer cylinder 30 with the rod 2 with an intended length to adjust the length of the rod 2.

The user loosens the bolt 54 to change the position and angle of the front grip 5 and tightens the bolt 54 with the front grip 5 at an intended position and an intended angle to adjust the position and angle of the front grip 5.

The user grips the grip 24 and the front grip 5 and pulls the trigger 32 with the trigger locking member 36 in an off-state. This turns on the switch, causing the controller to feed power from the battery 40 to the electric motor 86 through the terminal on the battery mount 26 and the rod lead wire (power lead wire). This drives the rotor 132 (motor shaft 134) to rotate. In this manner, the trigger 32 turns on or off the electric motor 86 through the switch. The trigger 32 is a switching member for turning on or off the electric motor 86. The trigger 32 and the switch form a main switch for the electric motor 86.

The controller controls the maximum rotational force of the electric motor 86 in accordance with the switching state of the speed adjustment dial 38. The controller controls the rotational force of the electric motor 86 in accordance with the pulling amount of the trigger 32 (switching state of the switch).

The driving force (rotational force) of the motor shaft 134 is reduced by the planetary gear assembly 88 before being transmitted to the spindle 90 and moves (rotates) the pad 92 or the brush 94 at the distal end of the spindle 90.

The user then places the head 8 on the cleaning target surface C by operating the grip 24 and the front grip 5 (handheld cleaning machine).

With the first restriction bolt 71 and the second restriction bolt 72 being loose, the peripheral body brush 204 and the peripheral attachment brush 224 in the peripheral portion 100 first come in contact with the cleaning target surface C. In response to the user further pressing the head 8 against the cleaning target surface C, the cleaning portion of the pad 92 or the brush 94 then comes in contact with the cleaning target surface C (FIG. 10). In other words, together with the pad lower surface 92A or the brush lower end 94A, the peripheral body brush 204 and the peripheral attachment brush 224 in the peripheral portion 100 facing the cleaning target surface C can be in contact with the cleaning target surface C. The peripheral body brush 204 and the peripheral attachment brush 224 come in contact with the cleaning target surface C before the pad lower surface 92A or the brush lower end 94A comes in contact with the cleaning target surface C.

The peripheral portion 100 then receives, at the lower ends of the peripheral body brush 204 and the peripheral attachment brush 224, a reaction force from the cleaning target surface C. The peripheral body 200 moves upward against the urging force from the leaf springs 202 with respect to the head cover 96 and the stopper 98. The upper end of the peripheral body 200 is received in a space inside the receiver 170 in the head cover 96. The projections 210 on the peripheral body 200 approach the lower surface of the head cover 96.

With the first restriction bolt 71 and the second restriction bolt 72 unfastened, the head 8 rotates about the two axes in a flexible manner, and the peripheral body brush 204 and the peripheral attachment brush 224 come in contact with the cleaning target surface C first. A pressing force is applied to the cleaning portion in a direction perpendicular to the cleaning portion (the axial direction of the peripheral portion 100, or the vertical direction in the drawings) alone. Any pressing force applied to the cleaning portion in other directions becomes a rotational force for the head 8 to rotate relative to the suspension frame unit 6. Thus, the entire cleaning portion comes in contact with the cleaning target surface C. This prevents the rotating cleaning portion from partially coming in contact with a target, causing the rod 2 and the body 4 to swing.

The user can place the rotating cleaning portion on the cleaning target surface C and clean the cleaning target surface C. When the user moves the head 8 relative to the cleaning target surface C in various directions, the peripheral portion 100 allows the entire cleaning portion to come in contact with the cleaning target surface C. When the user changes the posture of the rod 2 at various angles relative to the cleaning target surface C, the peripheral portion 100 allows the entire cleaning portion to come in contact with the cleaning target surface C.

For local cleaning, the user tightens the first restriction bolt 71 and the second restriction bolt 72.

The user can have the head 8 fixed relative to the suspension frame unit 6 with an intended posture by operating the rod 2 when the peripheral body brush 204 and the peripheral attachment brush 224 in the peripheral portion 100 are in contact with the cleaning target surface C. The user can thus partially place the cleaning portion on the cleaning target surface C.

In this case, the user applies force to restrict the rod 2 and the body 4 from swinging.

Figure 11:
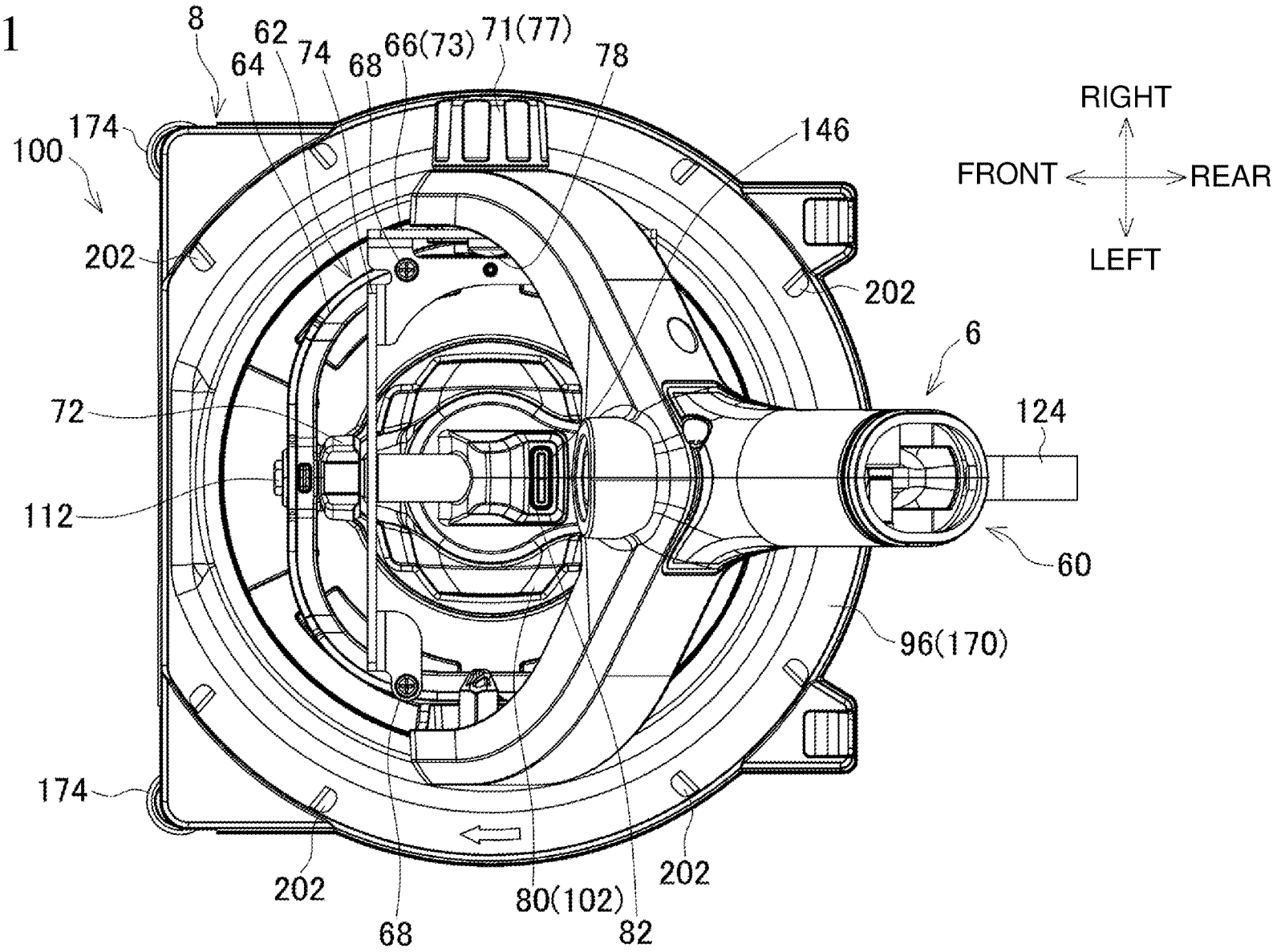
FIG. 11 is a view corresponding to FIG. 5 with a peripheral attachment detached.
Figure 12:
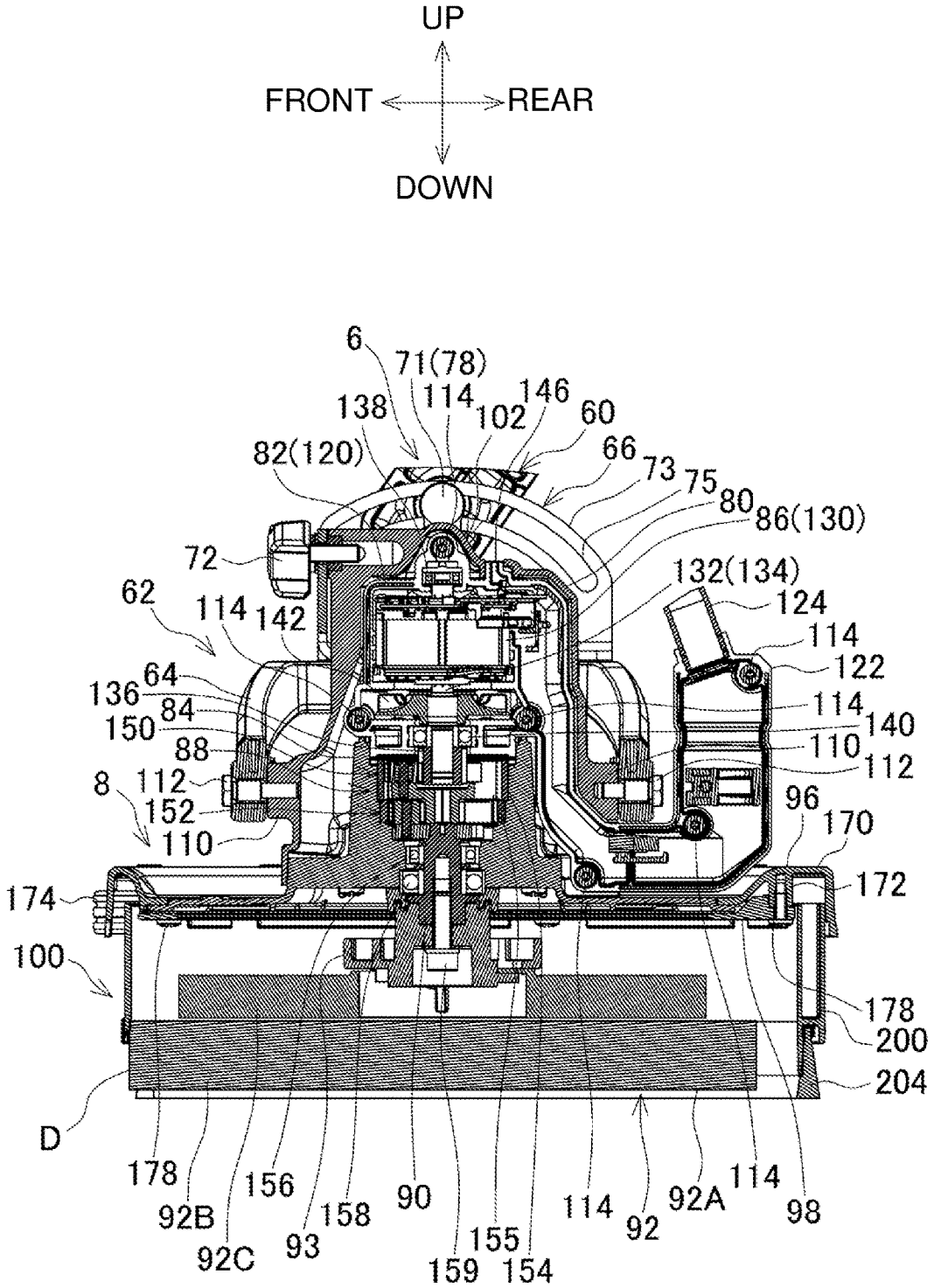
FIG. 12 is a view corresponding to FIG. 7 with the peripheral attachment detached and with a pad attached.

As shown in FIGS. 11 and 12, for cleaning a corner of a floor adjacent to a wall, for example, the user detaches the peripheral attachment 206.

This exposes a portion of, for example, the pad 92 radially outward from the peripheral portion 100 (an exposed portion D of the pad 92 in FIG. 12). The user can place, for example, the pad 92 on a floor corner. The user can thus clean, for example, corners of a floor adjacent to a wall sufficiently.

In this case as well, with the first restriction bolt 71 and the second restriction bolt 72 being loose, the peripheral portion 100 (peripheral body brush 204) allows the entire cleaning portion such as the entire pad 92 to come in contact with the cleaning target surface C, preventing the rod 2 and other components from swinging.

With the first restriction bolt 71 and the second restriction bolt 72 tightened, the user can partially place the cleaning portion on a target. In particular, the user can place the exposed portion D of the pad 92 and other portions on, for example, a corner of a floor and locally clean the corner of the floor.

In response to the head 8 being removed from the cleaning target surface C at a temporal end of the cleaning of the cleaning target surface C, the peripheral body 200, the peripheral body brush 204, and the peripheral attachment 206 return downward under the urging force from the leaf springs 202. This causes the peripheral body brush 204 and the peripheral attachment 206 to have their lower ends protruding downward in the vertical direction with respect to the cleaning portion. The stopper 98 prevents the peripheral portion 100 from slipping off downward.

During cleaning or during operation but not cleaning, the head cover 96, the stopper 98, and the peripheral portion 100 rotate upon coming in contact with, for example, a wall. At least either of the rollers 174 can come in contact with, for example, a wall. The roller 174 coming in contact with, for example, a wall reduces shock to the head 8 and allows smooth rotation of the peripheral portion 100 and other members.

As the motor shaft 134 rotates, the fan 142 rotates, discharging air through the internal outlets and the external outlets 144. This produces a flow of air (blow) from the inlet 146 toward the external outlets 144. The blow through an upper portion of the motor housing body 120 reaches the fan 142 in the middle portion.

The blow cools the internal components of the head 8 including the electric motor 86.

The scrubber 1 according to the present embodiment includes the pad 92 or the brush 94 including the cleaning portion (the pad lower surface 92A or the brush lower end 94A) to be placed on the cleaning target surface C, the head 8 receiving the pad 92 or the brush 94 that is movable with a driving force from the electric motor 86, the rod 2, and the suspension frame unit 6 placed between the head 8 and the rod 2. The head 8 includes the peripheral portion 100 surrounding the cleaning portion. Together with the cleaning portion, the surface-cleaning lateral portion (the peripheral body brush 204 and the peripheral attachment brush 224) in the peripheral portion 100 facing the cleaning target surface C can be in contact with the cleaning target surface C. The suspension frame unit 6 connects the head 8 to the rod 2 in a manner rotatable relative to the rod 2 about at least two axes. The suspension frame unit 6 includes the first restriction bolt 71 and the second restriction bolt 72 for partially or entirely restricting rotation of the head 8.

This structure allows the cleaning portion that can change its posture by rotating about two axes and the surface-cleaning lateral portion of the peripheral portion 100 to come in contact with the cleaning target surface C. This prevents the scrubber 1 from swinging due to partial contact of the cleaning portion. The first restriction bolt 71 and the second restriction bolt 72 lock the cleaning portion not to change its posture by rotating about two axes. This allows partial contact of the cleaning portion independently of the peripheral portion 100, thus allowing the scrubber 1 to perform local cleaning.

The surface-cleaning lateral portion of the tip tool comes in contact with the cleaning target surface C before the cleaning portion of the peripheral portion 100 comes in contact with the cleaning target surface C. This prevents the scrubber 1 from swinging in cleaning including an early stage of cleaning in which the surface-cleaning lateral portion of the tip tool is applied to the cleaning target surface C.

The first restriction bolt 71 and the second restriction bolt 72 each fasten multiple members movable relative to one another. The first restriction bolt 71 and the second restriction bolt 72 each include a bolt. This simple and easily operable structure restricts the rotation of the cleaning portion about the two axes.

The tip tool to be attached to the head 8 includes the brush 94. The scrubber 1 thus uses the tip tool that facilitates cleaning.

The peripheral body brush 204 and the peripheral attachment brush 224 are brushes. This prevents the cleaning target surface C from being stained or damaged by the peripheral portion 100 that prevents the scrubber 1 from swinging. A double-brush structure may include the tip tool being the brush 94 and the portions of the peripheral portion 100 facing the cleaning target surface C being the peripheral body brush 204 and the peripheral attachment brush 224.

The peripheral portion 100 includes the leaf springs 202 that urge the peripheral body brush 204 and the peripheral attachment brush 224 toward the cleaning target surface C. The peripheral portion 100 thus reliably supports the cleaning target surface C. For the surface-cleaning lateral portion to come in contact with the cleaning target surface C before the cleaning portion comes in contact with the cleaning target surface C, the surface-cleaning lateral portion more reliably comes in contact with the cleaning target surface C before the cleaning portion.

The peripheral portion 100 includes the peripheral body 200 and the peripheral attachment 206. The peripheral attachment 206 is attachable to and detachable from the peripheral body 200. The peripheral attachment 206 is detached to expose the exposed portion D of the pad 92. The exposed portion D of the pad 92 cleans, for example, the corners of the cleaning target surface C effectively.

The suspension frame unit 6 includes the outer frame 60 and the inner frame 62. The inner frame 62 can rotate, relative to the outer frame 60, about the first rotation axis extending laterally. The head 8 can rotate, relative to the inner frame 62, about the second rotation axis extending in the front-rear direction. The first restriction bolt 71 restricts rotation about the first rotation axis. The second restriction bolt 72 restricts rotation about the second rotation axis. The structure for restricting the rotation of the tip tool about two axes is thus easily operable and simple.

The embodiments and the modifications of the present disclosure are not limited to those described above. For example, the embodiments and modifications of the present disclosure may be further modified appropriately as described below.

The surface-cleaning lateral portion of the peripheral portion 100 may come in contact with the cleaning target surface C at positions corresponding to the vertices of an imaginary triangle, or in other words, at least three positions. For example, the surface-cleaning lateral portion may include small brushes at the left front, right front, left rear, and right rear of the tip tool.

In the suspension frame unit 6, the second frame connected to the head 8 may be connected to the outer surface of the first frame.

The rotator may be any rotator other than the suspension frame unit 6 including the first frame and the second frame that enables rotation about at least two axes. For example, the rotator may be a universal joint or a ball joint. The rotator may be an elastic member, such as a rubber block, that allows change in posture by rotation about at least two axes.

The surface-cleaning lateral portion of the peripheral portion 100 may come in contact with the cleaning target surface C at the same time as when the cleaning portion of the tip tool comes in contact with the cleaning target surface C. In this case as well, the scrubber 1 is prevented from swinging in cleaning including an early stage of cleaning. When temporal swinging in an early stage of cleaning is acceptable, the surface-cleaning lateral portion of the peripheral portion 100 may come in contact with the cleaning target surface C after the cleaning portion of the tip tool comes in contact with the cleaning target surface C.

The rotation restrictors may be pins that are received in multiple members movable relative to one another.

The tip tool may be any tool other than the pad 92 and the brush 94.

Instead of, or together with brushes such as the peripheral body brush 204 and the peripheral attachment brush 224 as the surface-cleaning lateral portion of the peripheral portion 100, an elastic member such as a rubber plate may be used.

The leaf springs 202 may be located between the peripheral body 200 and the peripheral body brush 204 or between the peripheral attachment body 220 and the peripheral attachment brush 224. The peripheral elastic members may be, instead of, or together with the leaf springs 202, at least either a coil spring or a rubber block. In this case, the rubber block may be ring shaped in conformance with the peripheral body 200.

The battery 40 may be attached to the battery mount 26 by sliding the battery 40 from the left to the right, downward from above, or in any other direction relative to the battery mount 26. The battery mount 26 may be located in any other portion on the body housing 18. At least the battery mount 26 or the battery 40 may be provided as multiple battery mounts 26 or multiple batteries 40. Instead of being on the body housing 18 or in addition to the body housing 18, the battery mount 26 may be located on the head housing 102. The battery 40 may be, for example, a hexagonal prism. The battery 40 may be a solid cylinder.

The planetary gear assembly 88 may have a single stage or three or more stages. A reducer of a different type may be used.

For example, the number, the arrangement, and the size of at least any of the internal outlets, the external outlets 144, and the inlet 146 may be modified variously.

The fan 142 may be any fan other than a centrifugal fan.

The electric motor 86 may be an outer-rotor motor or a brushed motor.

The electric motor 86 may be connectable to utility power with a power cable, or drivable with alternating current (AC).

The electric motor 86 may be located, for example, in the body 4.

The tip tool may move eccentrically with an eccentric spindle. The tip tool may reciprocate.

The tip tool may have any shape such as a triangle.

At least any of the functions, arrangements, types, models, and the numbers of components and portions may be modified as appropriate. For example, more or fewer bearings, screws, bolts, or buttons may be used. The buttons may be replaced by lever switches. The pinion 136 may be replaced by a belt and a pulley. The screws may be replaced by rivets. The motor housing 82 may be integral with the gear housing 84. The battery 40 on the battery mount 26 may be rechargeable. A non-rechargeable battery may be used. The battery may have a voltage other than 18 V. The battery may be any battery other than a lithium-ion battery.

The present disclosure is applicable to any other long rod cleaning machine such as a long rod polisher and a long rod buffing machine. The present disclosure is applicable to any other long rod power tool such as a long rod grinding machine.

The present disclosure is applicable to cleaning, for example, a cleaning target surface (e.g., a floor and a wall) in a house, a cleaning target surface in a house, and a cleaning target surface in a store. The present disclosure is applicable for household use, professional use including building maintenance, and any other use.

REFERENCE SIGNS LIST

A non-exhaustive list of some reference signs utilized in the enclosed Figures is below. For an exhaustive correspondence of reference numerals, please see the specification in its entirety.

1 scrubber (long rod cleaning machine)
2 rod
6 suspension frame unit (rotator)
8 head
60 outer frame (first frame)
62 inner frame (second frame)
71 first restriction bolt
72 second restriction bolt
86 electric motor
92 pad (tip tool)
92A pad lower surface (cleaning portion)
94 brush (tip tool, first brush)
94A brush lower end (cleaning portion)
100 peripheral portion
200 peripheral body
202 leaf spring (peripheral elastic member)
204 peripheral body brush (surface-cleaning lateral portion, second brush)
206 peripheral attachment
224 peripheral attachment brush (surface-cleaning lateral portion, second brush)
C cleaning target surface
D exposed portion (of tip tool)

The invention claimed is:

1. A long rod cleaning machine, comprising:
an electric motor;
a tip tool including a cleaning portion;
a head to which the tip tool is attachable, the tip tool being attached in a manner movable with a driving force from the electric motor, the head including
a peripheral portion surrounding the cleaning portion and including a surface-cleaning lateral portion configured to be in contact with a cleaning target surface together with the cleaning portion;
a rod; and
a rotator between the head and the rod, the rotator including
a first rotation restrictor configured to restrict rotation of the head about a first rotation axis, and
a second rotation restrictor configured to restrict rotation of the head about a second rotation axis, the second rotation axis extending in a different direction from the first rotation axis.

2. The long rod cleaning machine according to claim 1, wherein
the surface-cleaning lateral portion comes in contact with the cleaning target surface before or at contact of the cleaning portion with the cleaning target surface.

3. The long rod cleaning machine according to claim 2, wherein
the rotation restrictor fastens a plurality of members movable relative to one another.

4. The long rod cleaning machine according to claim 2, wherein
the first rotation restrictor and the second rotation restrictor each include a bolt.

5. The long rod cleaning machine according to claim 2, wherein
the tip tool includes a first brush.

6. The long rod cleaning machine according to claim 5, wherein
the surface-cleaning lateral portion includes a second brush.

7. The long rod cleaning machine according to claim 1, wherein
the first rotation restrictor and the second rotation restrictor fasten a plurality of members movable relative to one another.

8. The long rod cleaning machine according to claim 7, wherein
the first rotation restrictor and the second rotation restrictor each include a bolt.

9. The long rod cleaning machine according to claim 7, wherein
the tip tool includes a first brush.

10. The long rod cleaning machine according to claim 1, wherein
the first rotation restrictor and the second rotation restrictor each include a bolt.

11. The long rod cleaning machine according to claim 10, wherein
the tip tool includes a first brush.

12. The long rod cleaning machine according to claim 1, wherein
the tip tool includes a first brush.

13. The long rod cleaning machine according to claim 12, wherein
the surface-cleaning lateral portion includes a second brush.

14. The long rod cleaning machine according to claim 1, wherein
the peripheral portion includes a peripheral elastic member configured to urge the surface-cleaning lateral portion toward the cleaning target surface.

15. The long rod cleaning machine according to claim 1, wherein the peripheral portion includes a peripheral body, and a peripheral attachment attachable to and detachable from the peripheral body, and the tip tool is partially exposed with the peripheral attachment being detached.

16. The long rod cleaning machine according to claim 1, wherein the rotator includes a first frame, and a second frame rotatable relative to the first frame about the first rotation axis, and the head is rotatable relative to the second frame about the second rotation axis.

17. The long rod cleaning machine according to claim 16, wherein the first rotation restrictor is configured to fix the first frame and a first portion of a guide, to restrict the first portion from rotating relative to the first frame, and wherein the second rotation restrictor is configured to fix the second frame to the head, to restrict the head from rotating relative to a second portion of the guide.

18. The long rod cleaning machine according to claim 1, wherein the rotator includes a universal joint, a ball joint, or an elastic member.

19. The long rod cleaning machine according to claim 1, wherein the first rotation axis is perpendicular to the second rotation axis.

20. The long rod cleaning machine according to claim 1, wherein the first rotation restrictor is separate from the second rotation restrictor.

* * * * *